US005572290A

United States Patent [19]

Ueno et al.

[11] Patent Number: 5,572,290

[45] Date of Patent: Nov. 5, 1996

[54] ELECTROPHOTOGRAPHIC PRINTING SYSTEM INCLUDING A PLURALITY OF ELECTROPHOTOGRAPHIC PRINTERS HAVING ADJUSTABLE PRINTING SPEEDS

[75] Inventors: Hiroshi Ueno; Yasuyuki Tsuji; Shuuho Yokokawa; Kunitomo Takahashi; Isao Nakajima; Youji Hirose; Kazuo Takano; Takehiro Honda; Satoshi Aita; Isao Watanabe; Koji Doi; Tsukasa Onose; Syou Sawahata, all of Ibaraki, Japan

[73] Assignee: Hitachi Koki Co., Ltd., Tokyo, Japan

[21] Appl. No.: 510,619

[22] Filed: Aug. 3, 1995

[30] Foreign Application Priority Data

Aug. 5, 1994 [JP] Japan ..... 6-184553

[51] Int. Cl.[6] ..... G03G 15/00; G03G 15/20

[52] U.S. Cl. ..... 399/329

[58] Field of Search ..... 355/200, 285; 346/44; 219/216

[56] References Cited

FOREIGN PATENT DOCUMENTS 4-321062 11/1992 Japan .

*Primary Examiner*—Joan H. Pendegrass
*Assistant Examiner*—Quana Grainger
*Attorney, Agent, or Firm*—Sughrue, Mion, Zinn, Macpeak & Seas

[57] ABSTRACT

An electrophotographic apparatus system or an electrophotographic apparatus provided according to the present invention has the discrepancy of printing speed between tandem and single printing removed. The electrophotographic apparatus system or the electrophotographic apparatus is provided with printing speed changeover means 23*a*, 23*b*, 24 not only to select a printing speed applicable for the case where printing is effected with a plurality of electrophotographic apparatus A, B operatively linked together and another printing speed serviceable for the case where printing is implemented with each of plural electrophotographic apparatus put into separate run independently of one another, but also to shift the printing speeds from one to another, whereby the electrophotographic apparatus system or the electrophotographic apparatus may provide normal performance in each of the respective formations of printing.

3 Claims, 3 Drawing Sheets

ELECTROPHOTOGRAPHIC PRINTING SYSTEM INCLUDING A PLURALITY OF ELECTROPHOTOGRAPHIC PRINTERS HAVING ADJUSTABLE PRINTING SPEEDS

BACKGROUND OF THE INVENTION

1. Field of the Invention

The present invention relates to an electrophotographic device, and particularly to an electrophotographic apparatus using a longitudinally continuous printing paper.

2. Description of the Related Art

Japanese Patent Publication Laid-Open No. Hei 4-321062 discloses the art of an arrangement wherein a printing paper reversing device is provided between two electrophotographic apparatus disposed adjacent to one another and using one electrophotographic apparatus located upstream of the paper reversing device where a toner image is fixed on one side of a printing paper, and upon turning upside down by the printing paper reversing device the printing paper fed out from the electrophotographic apparatus, the printing paper is fed into another electrophotographic apparatus, downstream of the paper reversing device, where a toner image is fixed on another side of the paper, whereby respective toner images will be obtainable on both sides of the paper.

In an electrophotographic apparatus system constituted with some electrophotographic apparatus operatively linked together to provide the respective toner images on both sides of a printing paper, setting a preheater of a downstream-side electrophotographic apparatus at a temperature higher than the glass transition point of toner will entail such trouble that the toner image formed by the foremost electrophotographic apparatus undergoes re-softening and the toner image thus re-softened goes through friction with the preheater, staining said preheater and suffering degradation as well.

Therefore, where printing is effected on both sides of a printing paper in such an above-mentioned configuration of the electrophotographic apparatus system, it was required that the process of fixing be implemented with the minimum thermal efficiency which would not ill-affect the toner image formed by the foremost electrophotographic apparatus, whereby there used to be inevitably no alternative but to set the printing speeds of the respective electrophotographic apparatus to lower values.

However, selecting the printing speeds of electrophotographic apparatus to such a low speed suited to the electrophotographic apparatus system results in failure of those electrophotographic apparatus to fully demonstrate the originally feasible printing speeds in case where printing is effected with each of these electrophotographic apparatus put into separate run independently of one another, coming to a finding that the discrepancy of run between the respective cases, one where printing is carried out with the electrophotographic apparatus applied as the electrophotographic apparatus system, and the other where the individual electrophotographic apparatus are brought into run separately, still remains uncorrected.

In the description hereunder, the configuration of printing with the electrophotographic apparatus applied as the system is referred also to "tandem printing". Further, the formation of printing wherein individual electrophotographic apparatus are driven into separate run independently of one another is otherwise called as "single printing".

SUMMARY OF THE INVENTION

It is an object of the present invention to provide an electrophotographic apparatus system or an electrophotographic apparatus improved free from the discrepancy of running speed between tandem and single printing.

The above-mentioned object may be achieved by providing printing speed changeover means serving not only to select a printing speed applicable to one case where printing is done with a plurality of electrophotographic apparatus operatively linked together and another printing speed for the other case where the plurality of electrophotographic apparatus are separately run independently of each other, but also to shift the selected printing speeds from one to another.

According to the electrophotographic apparatus configured as in the foregoing, it is allowed that in tandem printing these electrophotographic apparatus are put into run under the conditions suited for this mode of printing while single printing takes place with each of the electrophotographic apparatus brought into run under the conditions fit for said mode of printing, with the discrepancy of run between the two cases removed thereby.

According to the present invention as in the foregoing, there is provided printing speed changeover means serving to not only to select a printing speed applicable to one case where printing is done with a plurality of electrophotographic apparatus operatively linked together and another printing speed for the other case where the plurality of electrophotographic apparatus are separately run independently of each other, but also to shift said printing speeds from one to another, whereby each printing formative discrepancy is removed, and therefore, the electrophotographic apparatus capable of demonstrating the original performances may be provided.

BRIEF DESCRIPTION OF THE DRAWINGS

The accompanying drawings, which are incorporated in and constitute a part of this specification, illustrate (an) embodiment(s) of the invention and, together with the description, serve to explain the objects, advantages and principles of the invention. In the drawings.

DETAILED DESCRIPTION OF THE PREFERRED EMBODIMENTS

Referring to the attached drawings, one embodiment of the present invention will be described hereunder.

First, the entire constitution of the electrophotographic apparatus is described with reference to FIG. 1.

Figure 1:
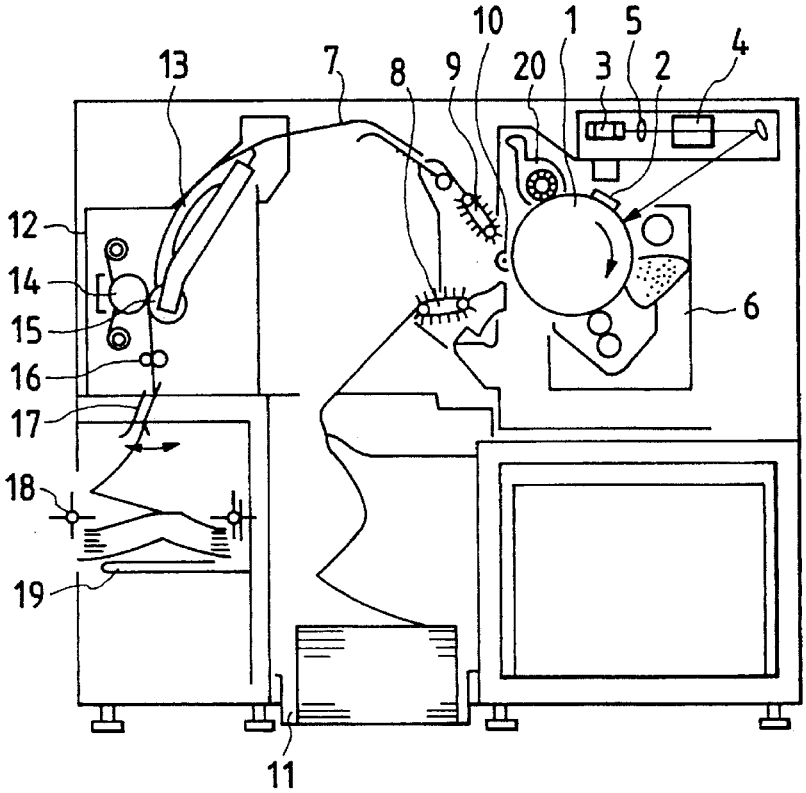
FIG. 1 is an approximate constitutional diagram of the electrophotographic apparatus according to the present invention.

In FIG. 1, reference numeral 1 designates a photosensitive drum. Photosensitive drum 1 starts to rotate according to a printing run start signal from a controller, runs at a speed corresponding to a printing speed of the electrophotographic apparatus and continues running until printing is over.

Upon the start of rotating photosensitive drum 1, high voltage is applied to corona charger 2 whereby the surface of photosensitive drum 1 is uniformly electrified, for example, with positive charge.

Rotating polygon mirror 3 starts to rotate immediately when the power supply is turned on to the electrophotographic apparatus and keeps high-precision running at a constant velocity while the power supply is on. The laser beam outputted from light source 4 consisting of a semiconductor laser or a light emitting diode is reflected by rotating polygon mirror 3 and irradiated upon photosensitive drum 1 via fθ lens 5, simultaneously scanning the surface thereof.

When the data of characters and those of figures after being converted into dot images are transmitted as laser beam on/off signals from the controller to the electrophotographic apparatus, the surface of photosensitive drum 1 is partly irradiated with the laser beam and partly unexposed thereto.

When the part within the surface of photosensitive drum 1, which part has lost the charge due to the irradiation of the laser beam thereon reaches a position opposing developing device 6, the toner electrified with positive charge is attracted by static electricity over to the surface of photosensitive drum 1, forming a toner image thereon.

Printing paper 7 is fed by tractors 8, 9 in synchronism with a timing of the arrival of a toner image of the data to be printed, which has been formed on the surface of photosensitive drum 1, at an image transfer position.

The toner image formed on the surface of photosensitive drum 1 is attracted over to the surface of printing paper 7 by image transfer unit 10 giving the rear side of printing paper 7 the charge with the polarity opposite to that of the toner image.

In this way, printing paper 7 set in paper hopper 11 is fed via tractor 8, image transfer unit 10 and tractor 9 to fixing device 12.

Printing paper 7 delivered to fixing device 12 is preheated by preheater 13 and subsequently caught by a nip portion made up of a pair of fixing rolls consisting heating roll 14 and pressing roll 15 for further transfer while being thereby heated and pressed, whereby the toner image gets fused to fixation on the printing paper 7. Printing paper 7 fed out by heating roll 14 and pressing roll 15 is further delivered by feed rolls 16 toward stacker table 19 while at the same time swayed back and forth alternately along the perforation therein due to the action of swaying by swing fin 17 and folded down into alignment by revolving paddle 18, thus getting stacked over stacker table 19.

The area of photosensitive drum 1, which has passed through the image transfer position, is cleaned by cleaning device 20, becoming ready for another cycle of printing.

Figure 2:
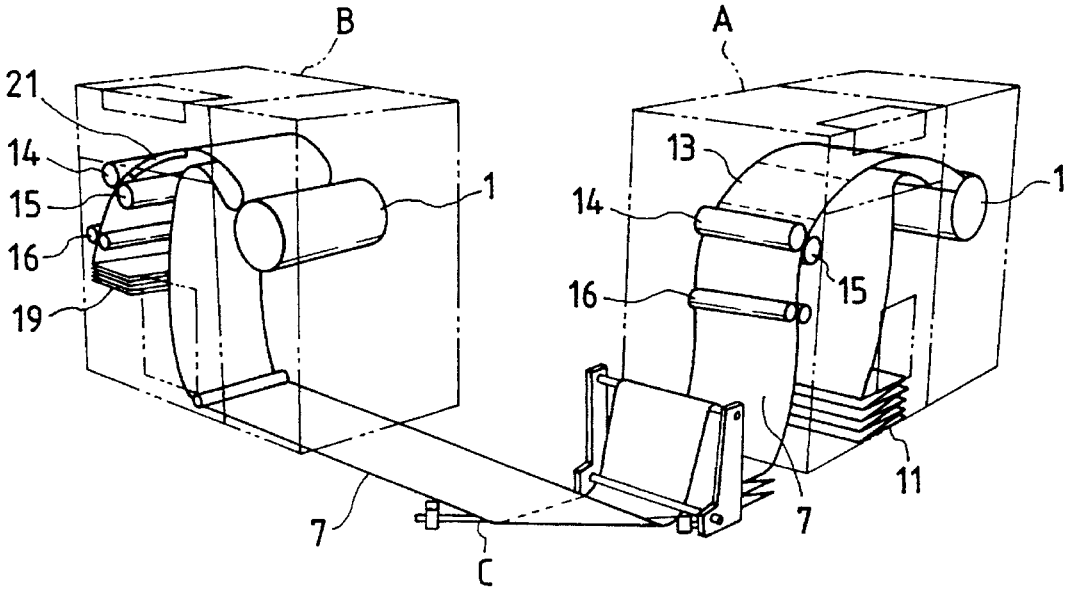
FIG. 2 is an approximate constitutional diagram showing one embodiment of the present invention for tandem printing.

The above-described sequence of operation takes place in single printing while in tandem printing, there is provided one more unit, for example, of such an electrophotographic apparatus as illustrated in FIG. 1 which is arranged as shown in FIG. 2. In such arrangement, printing paper 7 fed out from forefront electrophotographic apparatus A is turned upside doom by printing paper reversing device C, and then delivered into subsequent electrophotographic apparatus B wherein on the other side of printing paper 7, a toner image is formed. In this case, at preheater 21 of subsequent electrophotographic apparatus B, printing paper 7 has already had a toner image formed, through with fixing in forefront electrophotographic apparatus A, on the side opposite to preheater 21 while on the other side of printing paper 7, there has likewise been formed another toner image which is through with fixing in succeeding electrophotographic apparatus B. Nevertheless, according to the present invention, since the temperature of preheater 21 is changed over so that it may become lower than the glass transition point of toner, the toner image will not undergo re-softening thereby.

Figure 3:
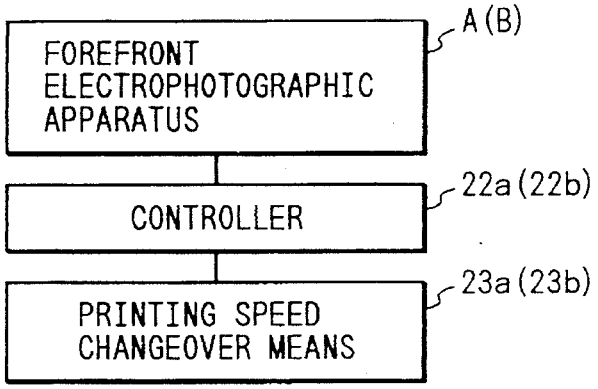
FIG. 3 is a block diagram showing a printing speed changeover means according to one embodiment of the present invention.

In undertaking selective implementation of single and tandem printing as described above, as regards the electrophotographic apparatus of the present invention, printing speed changeover devices **23*a* and 23*b* are coupled to controllers 22*a* and 22*b* of respective electrophotographic apparatus A, B as shown in FIG. 3** and depending on the selection made of either single or tandem printing, there takes place operator's manipulation of the printing speed changeover device(s), whereby each printing may be effected under appropriate conditions. With reference to the above-mentioned embodiment, a description was made of the case quoted where the preheater temperature of succeeding electrophotographic apparatus B was selected at less than the glass transition point of toner. However, the same effect is obtainable in such an arrangement wherein fixing is effected only through heating and pressing by respective fixing rolls instead of using a preheater.

Figure 4:
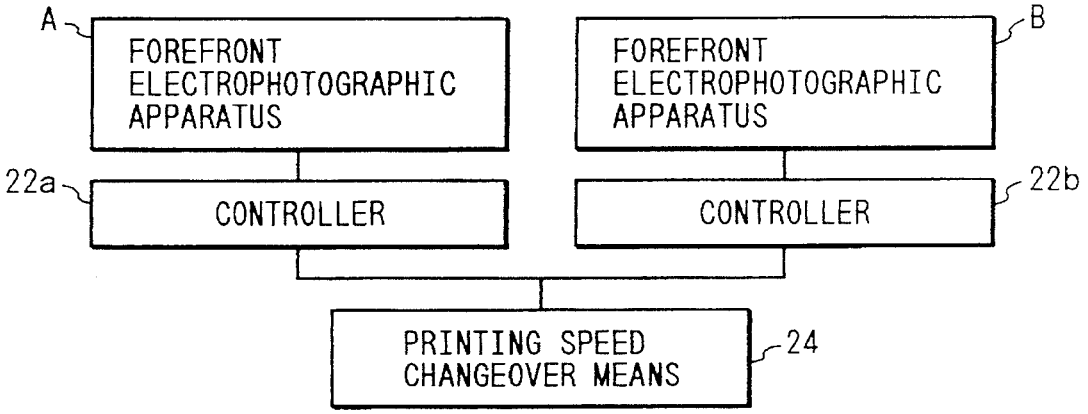
FIG. 4 is a block diagram showing the printing speed changeover means according to another embodiment of the present invention.

Further, as regards the printing speed changeover device, it is permissible that one unit of printing speed changeover device 24 is constituted to undertake a shift of printing speeds of plural electrophotographic apparatus such as shown in FIG. 4.

Figure 6:
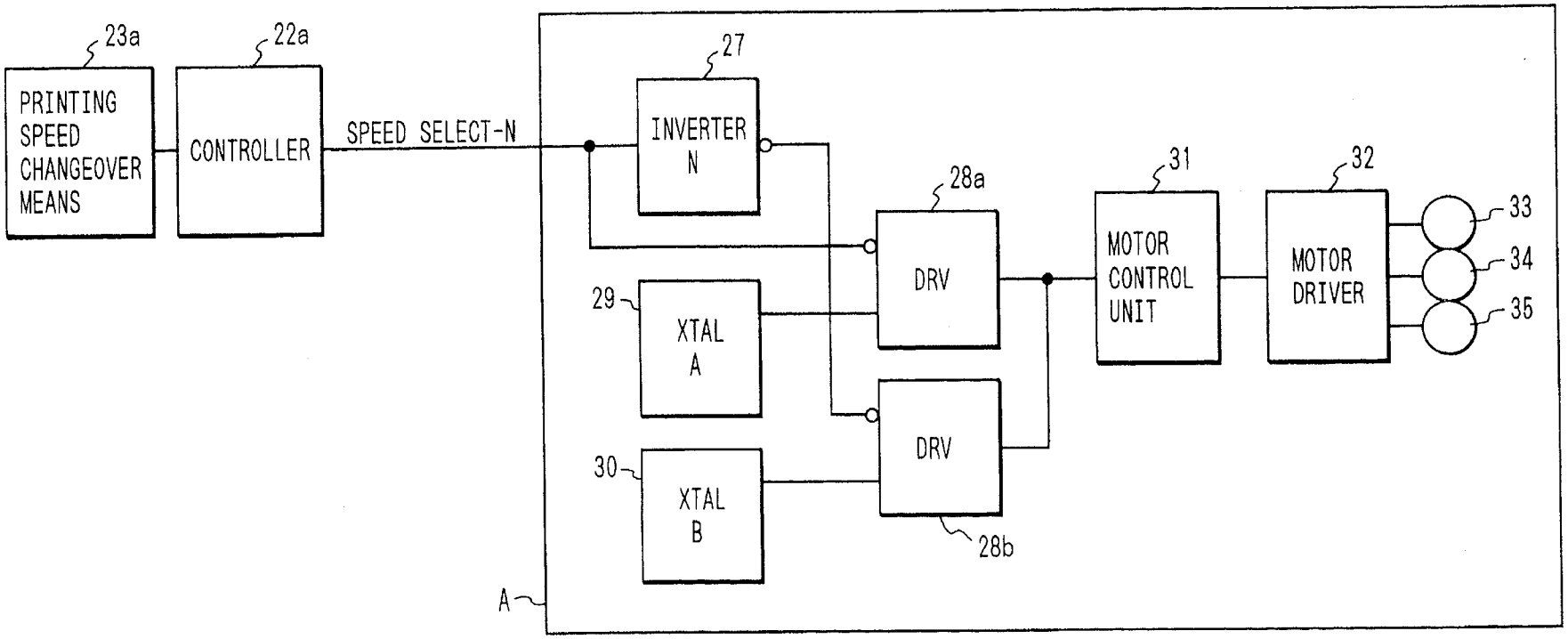
FIG. 6 is an illustrative diagram showing how the printing speed changeover means according to the present invention is constituted.

With reference to FIG. 6, a practical instance of the method of changing over printing speeds of electrophotographic apparatus A is described hereunder.

Controller **22*a* decides the printing speed of electrophotographic apparatus A, following the information from printing speed changeover device 23*a*. In this instance, printing speed changeover device 23*a*** is a general switch of the specification to select two speeds and capable of showing ON and OFF two states.

The printing speed selecting information from controller **22*a* is transferred according to an interface signal of SPEED SELECT-N provided between controller 22*a*** and electrophotographic apparatus A.

When SPEED SELECT-N stays at a TTL level and is in a state of "H," only the clock signal from system clock B30 is output via invertor 27 and drivers **28*a*, 28*b* to a motor control portion (when SPEED SELECT-N is in a state of "L," the clock signal from system clock A29** is output).

Motor control portion 31 is a general servo motor control circuit. Since a reference clock signal to decide the running speed of a servo motor is generated according to the clock signal from system clock A or B, selecting either system clock A or B following the information of printing speed provides the servo motor's running speed conforming to the clock signal from the system clock, whichever is selected.

As in the foregoing, by changing over, according to the information of printing speed, the running speeds respectively of drum motor 33, printing paper feed motor 34 and heat roll motor 35 coupled together to motor driver 33, printing speed shifting of electrophotographic apparatus A is achieved.

In case where printing is carried out, using one unit of the electrophotographic apparatus constituted as described above, there are formed monochromatic toner images on only one side of a continued printing paper.

Figure 5:
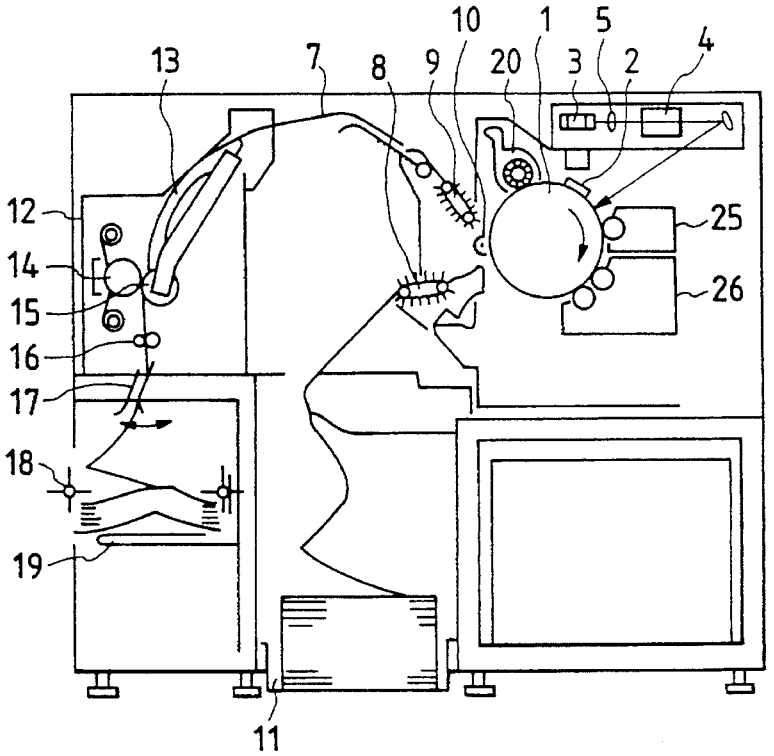
FIG. 5 is an approximate constitutional diagram of the electrophotographic apparatus according to the present invention.

Further, even one unit of the electrophotographic apparatus enables to form toner images of plural colors on one side of a continued printing paper if said electrophotographic apparatus is equipped with developing devices 25 and 26, each containing toner of different color as shown in FIG. 5 for example.

Further, the electrophotographic apparatus coupled together as shown in FIG. 2, each being of the constitution illustrated in FIG. 1, are capable of forming monochromatic toner images on both sides of the continuous printing paper. Meanwhile, coupling together the electrophotographic apparatus as shown in FIG. 2, each being of the constitution shown in FIG. 5 provides feasibility to form toner images of plural colors on both sides of the continuous printing paper.

Even in the case of tandem printing, coupling a plurality of electrophotographic apparatus together without use of printing paper reversing device C enables to form toner images on one side only of the continuous printing paper, for the printing paper is not turned upside down. In this case, as the printing paper is not reversed, it is not always necessary to control the preheater temperature at less than the glass transition point of toner.

Therefore, in this embodiment, tandem printing with a printing paper reversing device applied is effected in a manner so that printing speed will be controlled low by manipulating a printing speed changeover device.

Thus, the formation of printing may be modified variously, depending on the combination of the electrophotographic apparatus having one developing device with the other electrophotographic apparatus installed with a plurality of developing devices and whether or not a printing paper reversing device is employed.

While some specific embodiments have been described, it should be understood that the present invention is not limited to those embodiments, but may variously be modified, altered and changed within the scope of the present invention.

What is claimed is:

1. An electrophotographic system, comprising:

a first electrophotographic apparatus including a first preheater which is in contact with a conveyed recording material, for preheating the recording material, and first fixing means, disposed downstream of said first preheater in a recording material conveyance direction, for fixing a toner image formed on said recording material onto the recording material;

a second electrophotographic apparatus including a second preheater which is in contact with a conveyed recording material, for preheating the recording material, and second fixing means disposed downstream of said second preheater in a recording material conveyance direction, for fixing a toner image formed on said recording material onto the recording material; and a printing speed change-over unit that selects a first printing speed when said first and second electrophotographic apparatuses are operatively independent from each other for printing operation, and for setting a temperature of said second preheater to a temperature equal to or lower than the glass transition point of toner and selecting a second printing speed lower than said first printing speed when said first and second electrophotographic apparatuses are operatively linked together for printing operation.

2. An electrophotographic apparatus as claimed in claim 1, wherein each of said first and second fixing means comprises a plurality of fixing rolls for pressing the toner on said recording material, wherein, in the process of fixing the toner on the recording material by said fixing rolls for the case where printing is effected with said plurality of electrophotographic apparatuses operatively linked together, at the forefront electrophotographic apparatus, a toner image formed on the printing material is fixed thereto via the process of preheating by said preheater and the process of heating/pressing by said plurality of fixing rolls, and at the subsequent electrophotographic apparatus, a toner image formed on the printing paper is fixed thereto through the process of preheating by said preheater set at the temperature less than the glass transition point of toner and the process of heating/pressing by said plurality of fixing rolls.

3. An electrophotographic apparatus as claimed in claim 1, wherein each of said first and second fixing means comprises a plurality of fixing rolls for pressing the toner on said recording material and wherein, in the process of fixing for the case where printing is effected with said plurality of electrophotographic apparatus operatively linked together, there takes place the following at the forefront electrophotographic apparatus, a toner image formed on a printing material is fixed thereto via the process of preheating by said preheater and the process of heating/pressing by said plurality of fixing rolls, and at the subsequent electrophotographic apparatus, a toner image formed on the printing material is fixed thereto via only the process of heating/pressing by said plurality of fixing rolls.

* * * * *